United States Patent [19]

Kako

[11] Patent Number: 4,930,482

[45] Date of Patent: Jun. 5, 1990

[54] FUEL CONTROL APPARATUS FOR ENGINES

[75] Inventor: Hajime Kako, Hyogo, Japan

[73] Assignee: Mitsubishi Denki Kabushiki Kaisha, Tokyo, Japan

[21] Appl. No.: 361,086

[22] Filed: Jun. 5, 1989

[30] Foreign Application Priority Data

Jun. 15, 1988 [JP] Japan ..... 63-147277

[51] Int. Cl.[5] ..... F02D 41/10; F02D 41/30

[52] U.S. Cl. ..... 123/488; 123/478

[58] Field of Search ..... 123/478, 480, 488, 492, 123/493, 494

[56] References Cited

U.S. PATENT DOCUMENTS

| | | | |
|---|---|---|---|
| 4,010,717 | 3/1977 | Taplin | 123/488 X |
| 4,411,235 | 10/1983 | Shinoda et al. | 123/488 |
| 4,412,520 | 11/1983 | Mitsuyasu et al. | 123/488 |
| 4,413,602 | 11/1983 | Inoue et al. | 123/488 X |
| 4,651,695 | 3/1987 | Ohtaki eta l. | 123/492 X |

FOREIGN PATENT DOCUMENTS 58-24829 2/1983 Japan .

OTHER PUBLICATIONS

Shinji Ozawa "Digital Signal Processing" (1979. 7. 10) Jikkyo Shuppan Co., Ltd. pp. 103-104.

*Primary Examiner*—Willis R. Wolfe

*Attorney, Agent, or Firm*—Sughrue, Mion, Zinn, Macpeak and Seas

[57] ABSTRACT

An engine control apparatus for controlling fuel injection on the basis of a pressure value relating to the intake pipe pressure of an engine. All variations in the engine load are monitored and a detection signal is output when any variation is equal to or larger than a predetermined value. A timer is operable for a predetermined time in response to such detection signals. Fuel injection is controlled in response to the pressure value during the period when the timer is operative and in response to a value obtained by performing low-pass filter processing of the pressure value during the period when the timer is inoperative.

10 Claims, 8 Drawing Sheets

(a)
(PRIOR ART)
θ
t (b)
(PRIOR ART)
PbAD
t (c)
(PRIOR ART)
PbF
t (d)
(PRIORT ART)
LEAN
AIR FUEL
RATIO
RICH
t

θ
t

200ms
200/10
TIMER TM
0
t

PbAD
t

PbF
t

PbAE
t1
t2
t3
t4
t

FUEL CONTROL APPARATUS FOR ENGINES

BACKGROUND OF THE INVENTION

1. Field of the Invention

This invention relates to a fuel control apparatus for an internal combustion engine and, more particularly, to a fuel control apparatus for an engine for detecting the pressure in an intake pipe of the engine and controlling fuel injection on the basis of the detected pressure value.

2. Description of the Prior Art

It has hitherto been the practice to detect the pressure (intake negative pressure) in an intake pipe of an engine and control fuel injection, spark timing, etc., of the engine in response to the detected pressure signal. However, certain problems have been encountered since such a negative intake pressure includes a pulsating variation, so a surging phenomenon is generated if control operations are effected directly in response to the detection of the negative intake pressure, thereby resulting in incorrect control of various functional quantities.

To solve such problems, it has been known that a fuel control apparatus may be provided, in addition to a pressure sensor for sensing the pressure in the intake pipe, with a smoothing circuit for smoothing the output of the pressure sensor in order to remove any pulsation in the intake pressure and detect the mean value thereof, thereby preventing the occurrence of the surging phenomenon.

In this kind of fuel control apparatus, a pressure sensor which detects the pressure in the intake pipe (negative intake pressure) is provided in a position downstream of a throttle valve in the intake pipe which supplies the intake air to the engine. The detected signal output from the pressure sensor is supplied to the smoothing circuit comprising, for example, a filter, where the pulsation component is removed. The intake pressure signal from which the pulsation component has been removed by the smoothing circuit as described above is supplied to a control circuit for controlling fuel injection, etc., of the engine.

Such a conventional fuel control apparatus, however, has certain drawbacks in that, because of the smoothing of the pulsation contained in the intake pressure signal which is undertaken with a view to detecting a mean value thereof, there is response lag in the detection of the intake pressure during operation of the engine in a transitionary phase, i.e. during acceleration or deceleration, and in the case of a fuel injection control such a response lag results in a fuel undersupply which will cause the engine to stall.

This will be described below in more detail. Assuming that the opening $\theta$ of the throttle valve varies as time elapses as shown in FIG. 1(*a*), the pressure $Pb_{AD}$ in the intake pipe, i.e., the output signal of the pressure sensor varies as shown in FIG. 1(*b*). This pressure value $Pb_{AD}$ contains a ripple, as shown. When the pressure value containing the ripple is processed by the smoothing circuit, a smoothed pressure value $Pb_F$ as shown in FIG. 1(*c*) is obtained. This smoothed pressure value $Pb_F$ has a response delay relative to a variation in the intake pipe pressure $Pb_{AD}$ corresponding to a change in the actual throttle opening $\theta$ at the time of acceleration or deceleration, so that the air fuel ratio will become lean during acceleration and rich during deceleration, as shown in FIG. 1(*d*), and thus the engine performance during acceleration will be lowered and shocks will be generated due to the rough running of the engine during deceleration.

Japanese Patent Application Laid-Open No. 24829/1983 discloses a fuel control apparatus for an engine which is intended to solve the problem that the smoothed pressure value has a response lag relative to any change in the intake pipe pressure corresponding to a change in the throttle opening, and is arranged so that the function of the smoothing circuit which is designed to smooth the output of the pressure sensor is reduced or eliminated when the engine is in a transitionary condition, thereby improving the response of the intake pressure detection during such a transitionary state and inhibiting, as much as possible, the generation of surging due to pulsation of the intake pressure.

SUMMARY OF THE INVENTION

It is an object of the present invention to provide a fuel control apparatus for an engine in which the amount of fuel supply is determined on the basis of a filter-processed pressure value obtained by performing low-pass digital filter processing of the pressure value in the intake pipe in the steady condition and a pressure value in the intake pipe in the transitionary condition, thereby obtaining an appropriate air fuel ratio, enhancing the engine performance, and allowing for stable control of the engine.

The present invention is generally directed to an engine control apparatus for controlling fuel injection for an engine on the basis of a pressure value representing the pressure in an intake pipe of the engine.

According to one aspect, the engine control apparatus of the present invention comprises:

a filter means supplied with the pressure value and performing low-pass filter processing of the pressure value to output a filter-processed pressure value; and a load variation detecting means for monitoring variations in the load applied to the engine and adapted to output a detection signal when a variation in load is equal to or larger than a predetermined value.

The detection signal is input to a timer means which is operable for a predetermined period of time when the detection signal is input.

A selector means controlled by the timer means selects the pressure value during the period of time when the timer means is operative and the filter-processed pressure value during the period of time when the timer means is inoperative.

Fuel injection for the engine is controlled on the basis of either the pressure value or the filter-processed pressure value selected by the selector means.

It is desirable that the timer means is operable during the period from the time when the detection signal is input thereto until the time when the filter-processed pressure value becomes stable after the termination of variation in the load.

It is also desirable that the pressure value is a value obtained by A/D conversion of the intake pipe pressure value, and that the filter means performs digital filter processing of the A/D converted pressure value.

Additionally, it is desirable that the load variation detecting means consists of a means operative to monitor a throttle opening and detect any variation in the opening.

Volumetric efficiency is calculated on the basis of the number of revolutions of the engine as well as the pressure value or the filter-processed pressure value output from the selector means, and a pulse width for controlling fuel injection is calculated on the basis of the calculated volumetric efficiency.

The present invention, in accordance with another of its aspects, relates to an engine control apparatus for controlling fuel injection of the engine on the basis of a digital pressure value or a pressure value relating thereto which is obtained by A/D converting a pressure value of an engine intake pipe. This engine control apparatus comprises:

a low-pass digital filter means supplied with a digital pressure value for performing low-pass digital filter processing of the digital pressure value to allow a filter-processed pressure value to be output; and a load variation detecting means for monitoring variations in engine load and adapted to output a detection signal when any load variation is equal to or greater than a predetermined value.

This detection signal is input to a timer means which in tern operates for a predetermined time in response to the detection signal.

A selector means controlled by the timer means selects the digital pressure value during the period of time while the timer means is operative and the filter-processed pressure value during the period of time while the timer means is inoperative.

Fuel injection for the engine is controlled on the basis of the number of revolutions of the engine as well as the pressure value or the filter-processed pressure value output from said selector means.

An embodiment of the engine control apparatus in accordance with the present invention is adapted to control fuel injection for the engine on the basis of the number of revolutions of the engine and the throttle opening and a pressure value representing the pressure in an engine intake pipe, the apparatus comprising:

a digital filter means supplied with the pressure value for performing low-pass digital filter processing of the pressure value to output a filter-processed pressure value;

a load variation detecting means for monitoring variations in the throttle opening and adapted to output a detection signal when any variation of the throttle opening is equal to or larger than a predetermined value;

a timer means responsive to the detection signal and adapted to operate during the period from the time when the detection signal is input until the time when the filter-processed pressure value becomes stable after the variation in the throttle opening has caused;

a selector means controlled by the timer means for selecting the pressure value during the period when the timer means is operative and the filter-processed pressure value during the period when the timer means is inoperative;

a first means for calculating volumetric efficiency on the basis of the number of revolutions of the engine and the pressure value or the filter-processed pressure value selected by the selector means; and a second means for calculating a pulse width for controlling fuel injection for the engine, on the basis of the calculated volumetric efficiency.

Thus, fuel injection is controlled by selecting the pressure value representing the intake pipe pressure in the transitionary period during which the timer means is operative and by selecting the filter-processed pressure value averaged by performing low-pass digital filter processing of the pressure value in the steady condition during which the timer means is inoperative. In other words, the control of fuel injection is achieved by using a pressure value having a good response to any variation in the intake pipe pressure during a transitionary period, i.e., during acceleration or deceleration, and also by using a filter-processed pressure value representing an optimum value of the intake pipe pressure in the steady condition. This leads to the advantage that an optimum air fuel ratio can be established, that the driving performance of the engine is improved, and that stable fuel control is performed in the steady condition.

Other features and advantages of the present invention will become apparent from the following description with reference to the accompanying drawings.

DESCRIPTION OF THE PREFERRED EMBODIMENT

Figure 1:
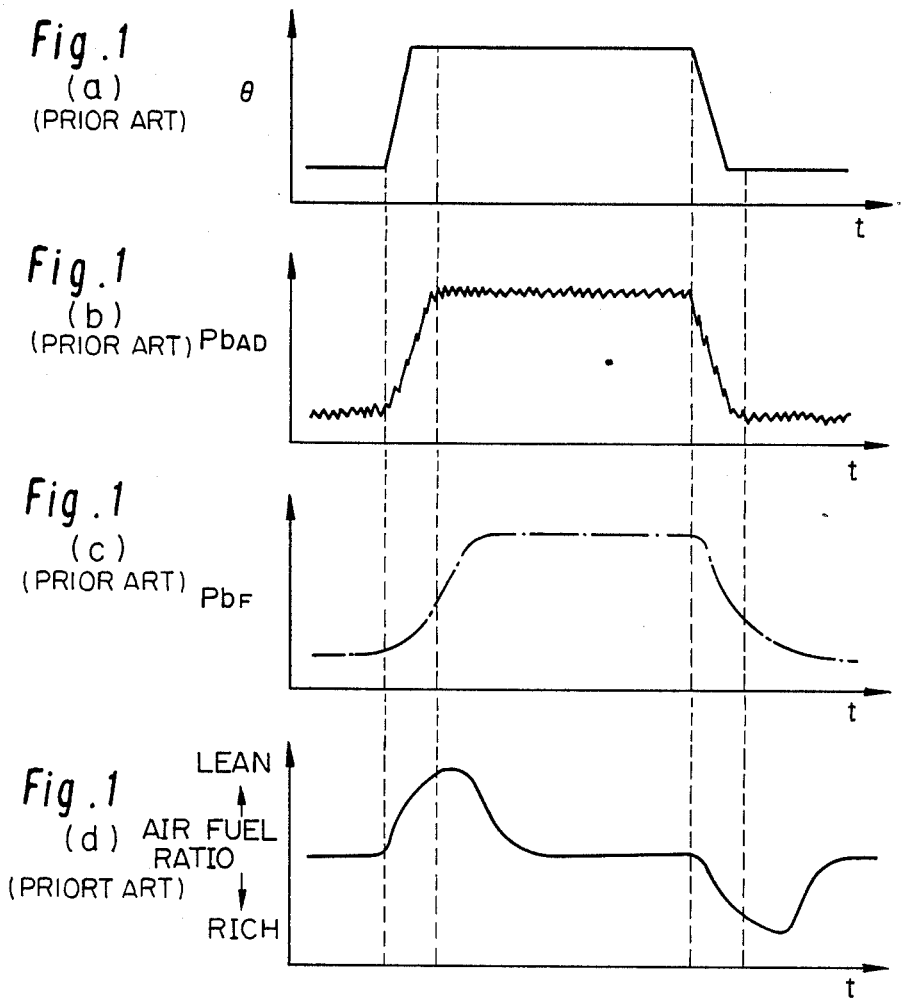
FIGS. 1, *a–d* show graphs explaining the operation of a conventional engine control apparatus.
Figure 2:
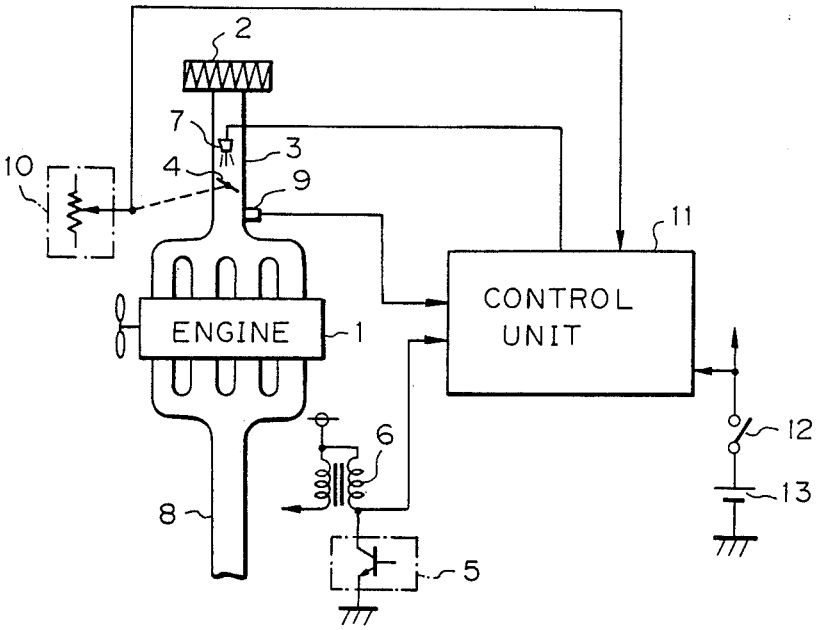
FIG. 2 is a schematic representation showing the electrical connection between an engine control apparatus in accordance with the present invention and an engine.

FIG. 2 schematically shows an electrical connection between a fuel control apparatus in accordance with the present invention and an engine arranged as a speed density type SPI device.

In this drawing, the engine 1 installed in, for example, a vehicle introduces air from an air cleaner 2 through an intake pipe 3 and a throttle valve 4. Upon ignition an igniter 5 is turned from ON to OFF by a signal from, for example, a signal generator (not shown) in a distributor. At the time of this transition a high voltage ignition signal is generated on the secondary side of an ignition coil 6 and supplied to an ignition plug (not shown) of the engine 1 to perform ignition. In synchronism with the generation of the ignition signal, fuel is supplied and injected from an injector 7 into the intake pipe 3 upstream of the throttle valve 4. The injected fuel is introduced into the engine 1 by the above-mentioned intake operation. After combustion, the exhaust gas is discharged from the engine 1 to the exterior by way of an exhaust manifold 8, etc.

On the other hand, the intake pipe pressure at a point in the intake pipe 3 downstream of the throttle valve 4 is detected in absolute pressure terms by a pressure sensor 9, and the opening of the throttle valve 4 is also detected by a throttle opening sensor 10. The respective analog detection signals having magnitudes corresponding to the absolute pressure and the throttle opening as well as the ignition signal of the igniter 5 are input to a control unit 11. The control unit 11 calculates fuel injection from the analog pressure detection signals and the ignition signal to perform control of the opening and closing of the injector 7.

Figure 3:
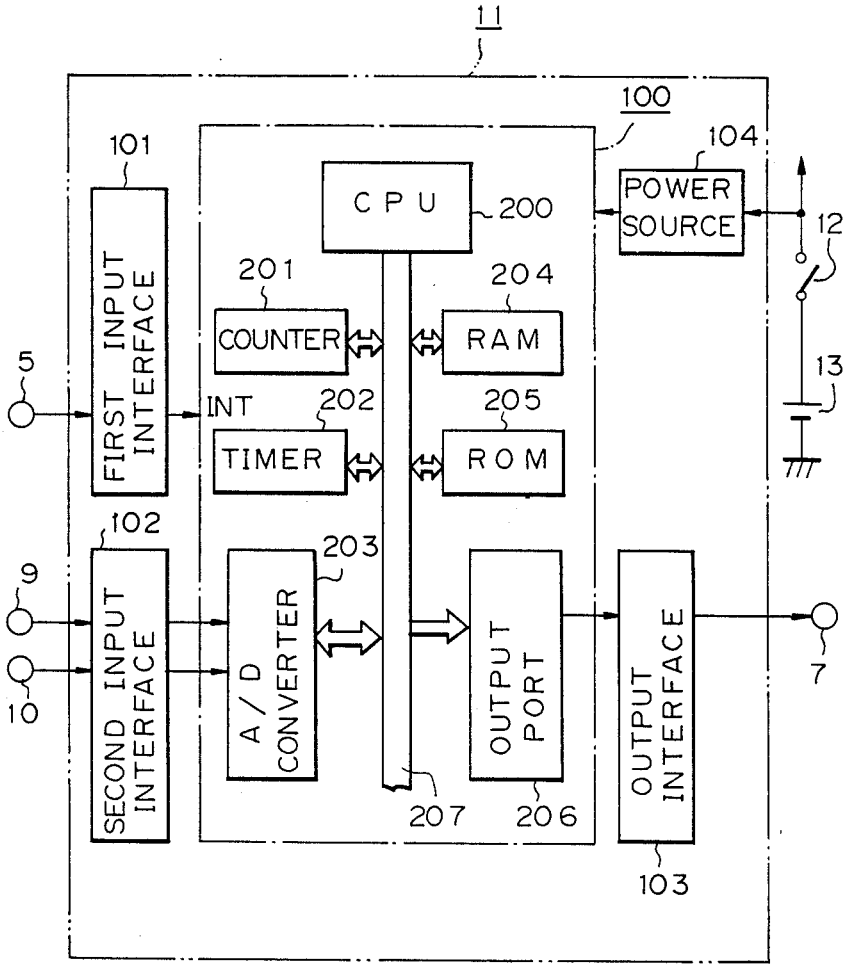
FIG. 3 is a block diagram showing the arrangement of the control unit of FIG. 2.

FIG. 3 is a block diagram showing the arrangement of the control unit 11 of FIG. 2. In FIG. 3, the control unit 11 comprises a microcomputer 100, a first input interface circuit 101, a second input interface circuit 102, an output interface circuit 103 and a power source circuit 104. The microcomputer 100 includes a CPU 200, a counter 201, a timer 202, and A/D converter 203, a RAM 204, a ROM 205 for storing a predetermined program (described below), an output port 206 and a bus 207. The ignition signal from the igniter 5 is subjected to waveform shaping in the first input interface circuit 101 and then input to the microcomputer 100 as an interrupt. At this time of interruption, a measured value of a cycle of the ignition signal in the counter 201 is read and stored in the RAM 204 which is used for detecting the number of revolutions. The output signals from the pressure sensor 9 and the throttle opening sensor 10 are subjected to wave-form shaping and noise removal in the second input interface circuit 102 and are thereafter successively A/D converted by the A/D converter 203. Fuel injection is calculated by a valve opening period of the injector 7 and set in the timer 202 with or without correction. During the time when the timer 202 is operative, a voltage of a predetermined level is output from the output port 206 and subjected to voltage-current conversion in the output interface circuit 103 to open the valve of the injector 7. The microcomputer 100 is operated by receiving a constant voltage from the power source circuit 104 to which the voltage of a battery 13 is input through a key switch 12.

The operation of CPU 200 will be described by reference to FIG. 4. At step S11, the number of revolutions of the engine $N_e$ is calculated from the measured value of the cycle of the ignition signal and then stored in RAM 204. At step S12, the output signal from the pressure sensor 9 is A/D converted by the A/D converter 203 and stored in RAM 204 as an A/D conversion value of the intake pipe pressure $Pb_{AD}$ (hereinafter referred to as a pressure value). Because the pressure value $Pb_{AD}$ contains a ripple component resulting from pulsation in the air suction, the pressure value $Pb_{AD}$ is subjected to a secondary low-pass digital filter process (described below) in step S13 which serves to stabilize the control, in order to obtain a filter-processed value of the intake pipe pressure value $Pb_F$ (hereinafter referred to as a filter-processed pressure value). In step S14, the output signal of the throttle opening sensor 10 is A/D converted to detect a throttle opening value $\theta$. In step S15, a variation of the throttle opening $\theta$ is detected, which detection causes the timer TM (stored in RAM 204) to be set or be decremented. This step S15 will be concretely described later. In step S16, a decision is made as to whether or not the set value of the timer TM is equal to 0. If not 0, a pressure value for calculation, $Pb_{AE}$, is set to be equal to the pressure value $Pb_{AD}$ in a step S17. If 0, a pressure value for calculation, $Pb_{AE}$, is set to be equal to the filter-processed pressure value $Pb_F$ in step S18. Subsequent to the step S17 or S18, the program proceeds to step S19 in which two-dimensional mapping is performed by using the previously calculated number of revolutions $N_e$ and the pressure value for calculation $Pb_{AE}$ to calculate the volumetric efficiency $C_{EV}$ ($N_E$, $Pb_{AE}$) which has been experimentally obtained for every air fuel ratio in correspondence with the number of revolutions and the pressure value. At step S20, a calculation is performed in accordance with the equation $T_{PW}=K\times Pb_{AE}\times C_{EV}$ (where K=constant) to calculate a pulse width $T_{PW}$ corresponding to fuel injection. After the process in step S20, the program returns to step S11 and repeats the above-described operation. The calculated pulse width $T_{PW}$ is set with or without correction in the timer 202 in synchronism with the generation of each ignition signal, thereby serving to operate the timer 202.

A digital filter for performing the secondary low-pass digital filter processing in step S13 will now be described. Let's suppose that the transfer function H(s) of a desired analog filter has been obtained. Its frequency characteristic is given by $H(j\omega_A)$. It is apparent that the frequency characteristic $H_D(e^{j\omega_D T})$ of the system function $H_D(z)$ of the digital filter obtained by mapping the imaginary axis of the s-plane $s=j\omega_A$ on a unit circle on the z-plane is the same value as that of $H(j\omega_A)$. The relationship between the frequency $\omega_A$ of the analog filter and the frequency $\omega_D T$ of the digital filter is determined by a mapping function, but the simplest function for mapping the imaginary axis on the unit circle is:

$$s = \frac{z-1}{z+1} \tag{1}$$

The relationship between $\omega_A$ and $\omega_D$ is:

$$j\omega_A = \frac{e^{j\omega_D T}-1}{e^{j\omega_D T}+1}$$

By arranging this, the following equation is obtained.

$$\omega_A = \tan\frac{\omega_D T}{2}$$

If the sampling cycle $T=6\times10^{-3}$ sec, the cut-off frequency $F_C=5$ Hz, and $Q=1/\sqrt{2}$, the transfer function of the secondary low-pass digital filter is expressed as follows:

$$H(s) = \frac{\omega_A^2}{s^2+\sqrt{2}\,\omega_A\cdot s+\omega_A^2} \tag{2}$$

where $$\omega_A = \tan\left(\frac{2\pi f_c\cdot T}{2}\right) = 0.0945$$

By substituting the equation (1) for the equation (2), the following equation is obtained:

$$H(z) = g_K\cdot\frac{1+2z^{-1}+z^{-2}}{1-e_K\cdot z^{-1}-f_K\cdot z^{-2}} \tag{3}$$

where $$g_K = \frac{\omega_A^2}{1+\sqrt{2}\,\omega_A+\omega_A^2} = 0.00782$$

$$e_K = \frac{2(1-\omega_A^2)}{1+\sqrt{2}\,\omega_A+\omega_A^2} = 1.735$$

-continued $$f_K = -\frac{1-\sqrt{2}\,\omega_A+\omega_A^2}{1+\sqrt{2}\,\omega_A+\omega_A^2} = -0.766$$

Figure 5:
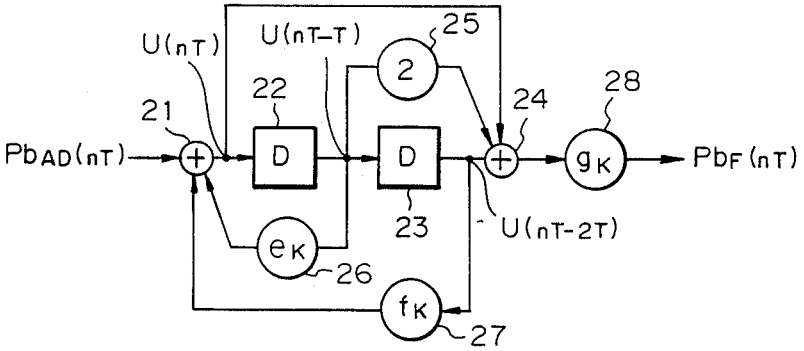
FIG. 5 is a block diagram of a digital filter for the secondary low-pass digital filter process in step S13 of FIG. 4.

The equation (3) can be expressed in the form of such a block diagram as shown in FIG. 5. In FIG. 5, the reference numerals 21 and 24 denote adders; 22 and 23 T-second time delay elements; 25 a circuit for multiplying the coefficient of 2; 26 a circuit for multiplying the coefficient of $e_K$; 27 a circuit for multiplying the coefficient of $f_K$; and 28 a circuit for multiplying the coefficient of $g_K$. The reference sign $Pb_{AD}(nT)$ denotes the pressure value at the n-th sampling (the present time); $Pb_F(nT)$ a filter-processed pressure value corresponding to the n-th sampling; U an intermediate variable; and U(nT), U(nT−T) and U(nT−2T) intermediate variables at the present time, the previous time and the time preceding the previous time, respectively.

The block diagram of FIG. 5 can be expressed by the following difference equations:

$$\left.\begin{aligned} Pb_F(nT) &= g_K\cdot\{U(nT)+2U(nT-T)+U(nT-2T)\} && (4a)\\ U(nT) &= Pb_{AD}(nT)+e_K\cdot U(nT-T)+f_K\cdot U(nT-2T) && (4b)\end{aligned}\right\}(4)$$

Figure 6:
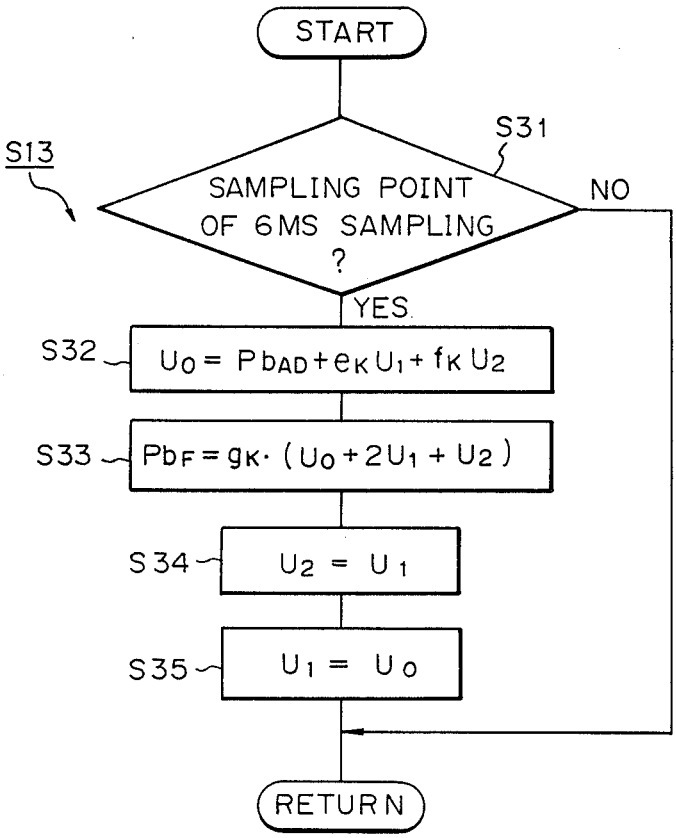
FIG. 6 is a flowchart showing in detail step S13 of FIG. 4.

Furthermore, the equations (4) can be expressed in the form of a flowchart such as that shown in FIG. 6.

As shown in FIG. 6, a decision is made in step S31 as to whether or not the present time coincides with the sampling point (the sampling cycle T being, for example, 6 mS). If not, the process proceeds to step S14 of FIG. 4, and if yes, a calculation for obtaining the intermediate value $U_0$ at the present time is made in accordance with the equation of $U_0=Pb_{AD}+e_K\cdot U_1+f_K\cdot U_2$ by using the pressure value at the present time $Pb_{AD}$, the coefficients of $e_K$ and $f_K$, and the intermediate values $U_1$ and $U_2$ at the previous time and the time preceding that, as shown by the equation (4*b*). In step S33, the filter-processed pressure value $Pb_F$ at the present time is obtained in accordance with the equation of $Pb_F=g_K\cdot(U_0+2U_1+U_2)$ as shown in the equation (4*a*) by using the coefficient $g_K$ and the intermediate values $U_0$, $U_1$ and $U_2$ at the present, and two preceding times, and stored in RAM 204. In step S34, the intermediate value $U_1$ at the last time is stored in RAM 204 as the intermediate value $U_2$ at the time preceding the previous time. In step S35, the intermediate value $U_0$ at the present time is stored in RAM 204 as the intermediate value $U_1$ at the previous time, and then the process proceeds to the step S14 shown in FIG. 4.

Figure 4:
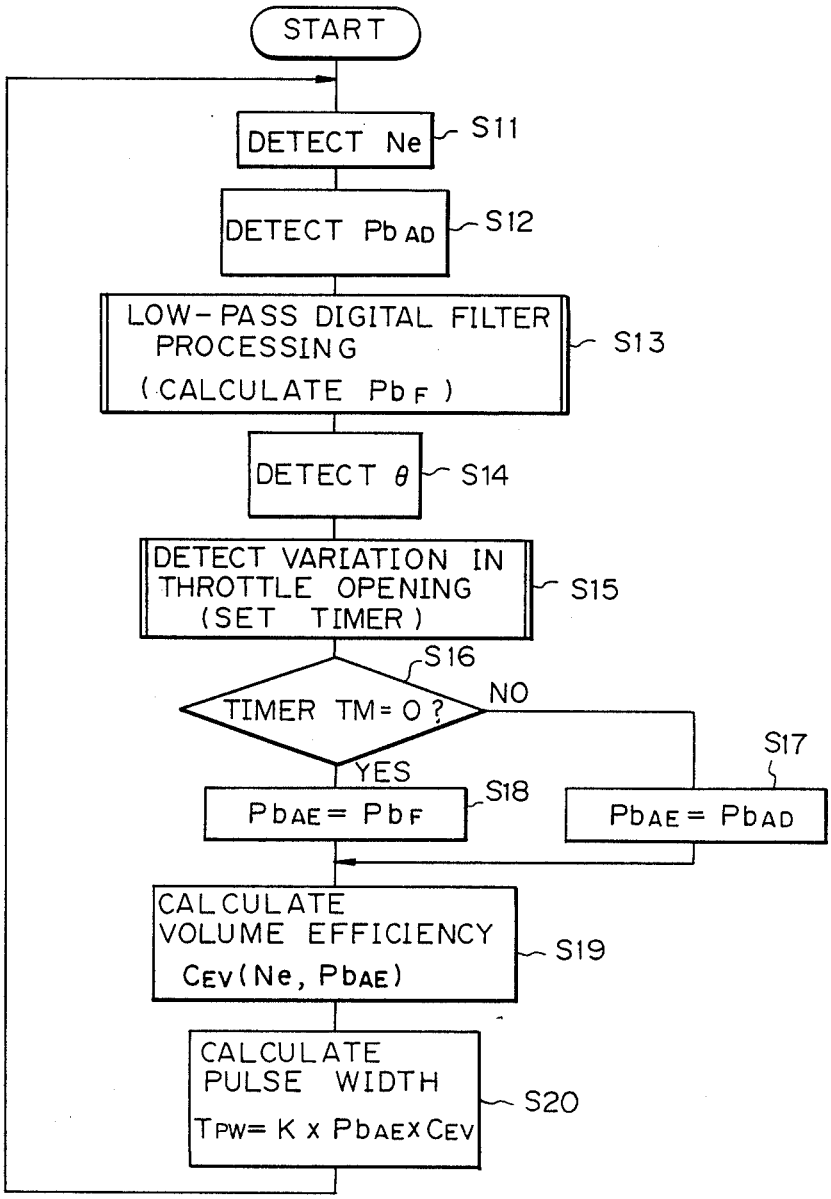
FIG. 4 is a flowchart explaining the operation of CPU 200 of FIG. 3.
Figure 7:
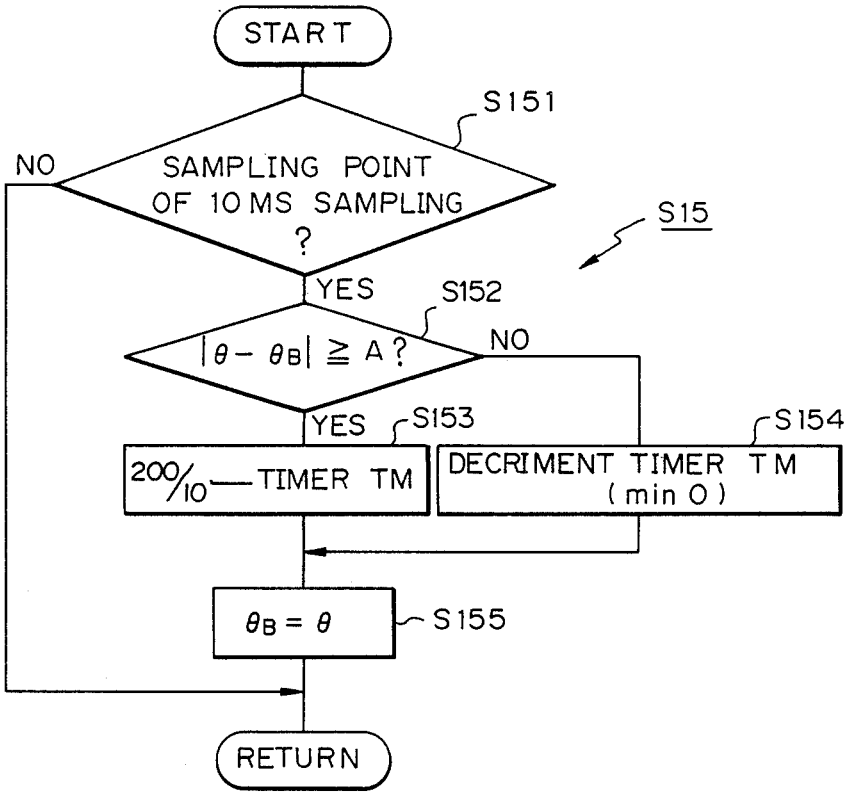
FIG. 7 is a flowchart showing in detail step S15 of FIG. 4.

The step S15 of FIG. 4 is established by a plurality of steps S151–S155 as shown in FIG. 7. In step S151, a decision is made as to whether or not the present time coincides with the sampling point, the sampling cycle being 10 mS. If not, the process proceeds to step S16. If yes, a decision is made in step S152 as to whether or not the absolute value $|\theta-\theta_B|$, the difference between the throttle opening value $\theta$ at the present time and the throttle opening value $\theta_B$ at the previous time (10 mS before the present time), is equal to or larger than a predetermined value A. If the absolute value is equal to or larger than the predetermined value A, the timer TM is set to the value 20 (corresponding to 200 mS) in step S153. If the absolute value is less than the value A, the timer TM is decremented by 1 in step S154, and if the timer TM is 0 it is not decremented but is kept in the 0 state. Subsequent to step S153 or S154, the process proceeds to step S155 at which the throttle opening value $\theta_B$ at the previous time is renewed by adopting the throttle opening value $\theta$ subsisting at the present time, and the process proceeds to step S16.

Figure 8:
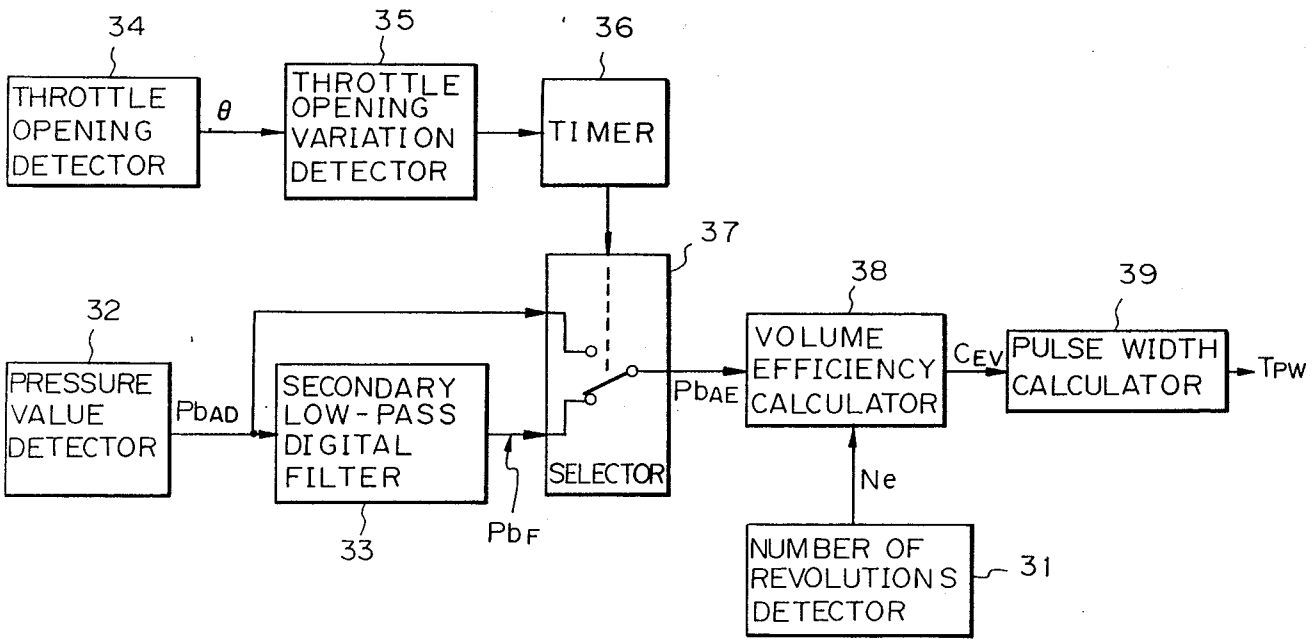
FIG. 8 is a block diagram showing the arrangement of an embodiment of the engine control apparatus of the present invention on the basis of the flowchart of FIG. 4.

It will be appreciated that each step of the program flowchart shown in FIG. 4 may be considered to be a means for carrying out the relevant function thereof, and the interrelationship between these means is shown in FIG. 8. The step S11 corresponds to a number-of-revolutions detecting means 31 for detecting the number of revolutions $N_e$ of the engine. The step S12 corresponds to a pressure value detecting means 32 for detecting the A/D conversion value $Pb_{AD}$ of the intake pipe pressure. The step S13 corresponds to a secondary low-pass digital filter means 33 for inputting the pressure value $Pb_{AD}$, performing the low-pass digital filter processing of the pressure value and outputting the filter-processed pressure value $Pb_F$ which is a filter-processed value of the intake pipe pressure. The step S14 corresponds to a throttle opening detecting means 34 for detecting the A/D conversion value $\theta$ of the throttle opening (hereinafter referred to as a throttle opening value). The step S15 corresponds to a throttle opening variation detecting means 35 for inputting the throttle opening value $\theta$ and detecting at predetermined intervals whether the variation has become equal to or higher than a predetermined value. The step S16 corresponds to a timer means 36 for receiving the detection signal of the throttle opening variation and outputting an operation signal indicating whether the throttle opening is changing or whether a predetermined time has not yet elapsed following the end of any variation in the throttle opening. The steps S17 and S18 correspond to a selector means 37 for selecting the pressure value $Pb_{AD}$ during the period in which the operation signal is being output from the timer means 36 and selecting the filter-processed pressure value $Pb_F$, the output of the secondary low-pass digital filter means 33, in the period in which there is no operation signal from the timer means 36, thereby outputting an intake pipe pressure value for calculation $Pb_{AE}$, that is, the pressure value to be used in calculation. The step S19 corresponds to a volumetric efficiency calculating means 38 for calculating the volumetric efficiency $C_{EV}$ using the number of revolutions $N_e$ and the pressure value to be calculated $Pb_{AE}$. The step S20 corresponds to a pulse width calculating means 39 for calculating the pulse width $T_{PW}$ corresponding to fuel injection, using the volumetric efficiency $C_{EV}$ and the pressure value to be calculated $Pb_{AE}$.

Figure 9:
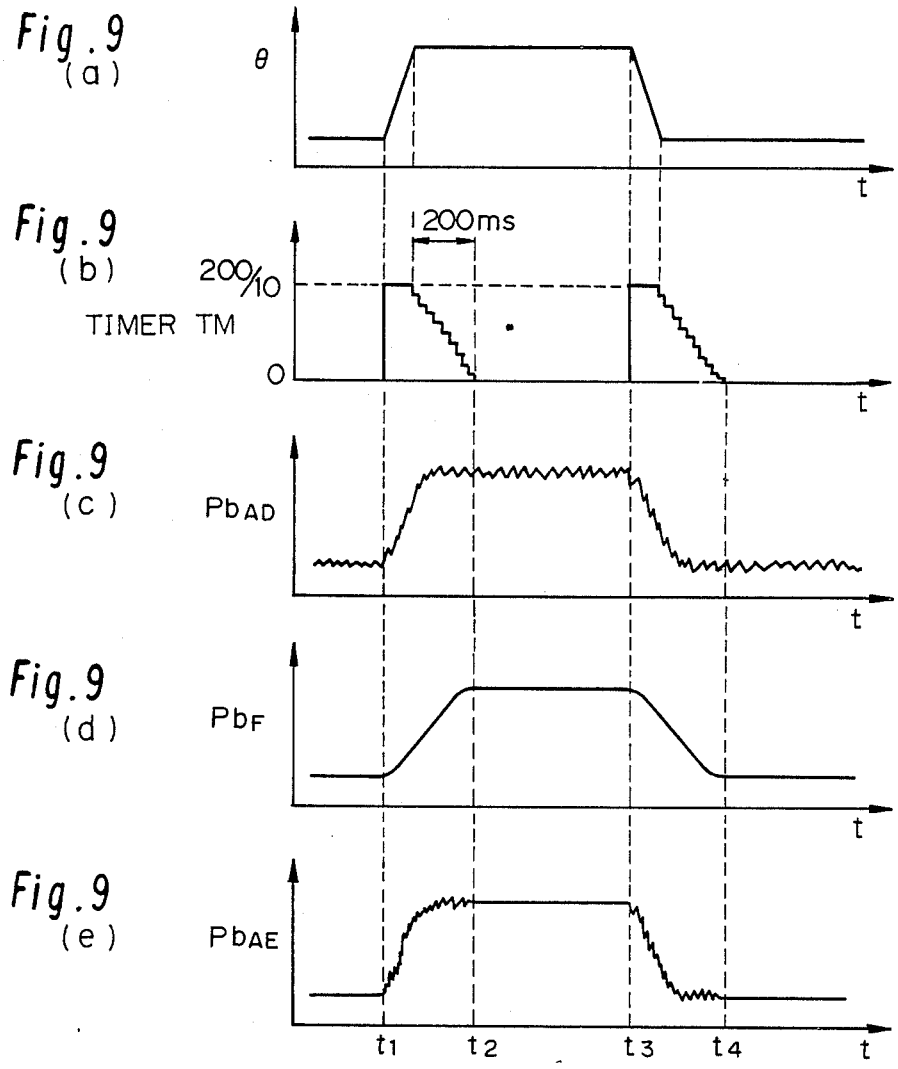
FIGS. 9, *a–e* show waveforms of signals at important portion of FIG. 8 and mutual timings thereof.

FIG. 9 shows variations in time in the respective signals in the above-described embodiment: (a) shows the throttle opening value $\theta$; (b) the time value; (c) the pressure value $Pb_{AD}$; (d) the filter-processed pressure value $Pb_F$; and (e) the pressure value to be calculated $Pb_{AE}$. Now assuming that acceleration is performed between time $t_1$ and time $t_2$ and deceleration is performed between time $t_3$ and time $t_4$, it is understood that within these periods the output value of the timer means 36 is not 0 as shown in FIG. 9(*b*). Accordingly, the pressure value $Pb_{AD}$ is used as the pressure value to be calculated $Pb_{AE}$. But in the remaining period the timer means 36 is set at 0 and so the filter-processed pressure value $Pb_F$ is used as the pressure value to be calculated $Pb_{AE}$. Therefore, the waveforms of FIGS. 9(*c*) and (*e*)

have a similar shape having the same timing, and it is therefore understood that the timing usable for calculating the detection value of the intake pipe pressure has a delay which is negligible relative to variations in the intake pipe pressure during all periods of time including those when acceleration or deceleration is occurring.

In the embodiment described above, the timer means is set at 200 msec. in order to take account of the time required for the filter-processed pressure value $Pb_F$ to become stable in the non-delay condition after the throttle opening has been varied.

Although the present invention has been described in detail by reference to certain embodiments, various alterations and modifications can be made within the spirit and scope of the invention. For example, in the above-described embodiments, the timer has been described as a software timer, but instead of this a timer contained in the microcomputer 100 may be used. Alternatively, a hardware timer may also be provided outside of the microcomputer 100.

What is claimed is:

1. An engine control apparatus for controlling fuel injection of an engine on the basis of a pressure value relating to the pressure in an intake pipe of the engine, comprising:

a filter means supplied with said pressure value and performing low-pass filter processing of said pressure value to output a filter-processed pressure value;

a load variation detecting means for monitoring load variations of said engine to output a detection signal when any load variation is equal to or larger than a predetermined value;

a timer means operable for a predetermined period of time in response to said detection signal; and a selector means controlled by said timer means and operable to select said pressure value during the period of time when said timer means is operative and said filter-processed pressure value during the period of time when said timer means is inoperative;

whereby fuel injection of said engine is controlled on the basis of either the pressure value or the filter-processed pressure value selected by said selector means.

2. An apparatus as set forth in claim 1, wherein said predetermined period of time in which said timer is operative extends between the time when said detection signal is input to said timer means and the time when said filter-processed pressure value becomes stable after the end of any variation in load.

3. An apparatus as set forth in claim 2, wherein said pressure value is a value obtained by A/D conversion of said intake pipe pressure value, and said filter means performs digital filter processing of said A/D converted pressure value.

4. An apparatus as set forth in claim 2, wherein said load variation detecting means is a means for monitoring a throttle opening to detect any variation in the opening.

5. An apparatus as set forth in claim 2, further comprising a means for calculating volumetric efficiency on the basis of the number of revolutions of said engine as well as the pressure value or the filter-processed value output from said selector means, and a means for calculating a pulse width for controlling fuel injection on the basis of said calculated volumetric efficiency.

6. An engine control apparatus for controlling fuel injection of an engine on the basis of a digital pressure value or a pressure value relating thereto obtained by A/D converting a pressure value of the engine intake pipe, the apparatus comprising:

a low-pass digital filter means supplied with said digital pressure value and performing low-pass digital filter processing of said digital pressure value to output a filter-processed pressure value;

a load variation detecting means for monitoring variations in load of said engine to output a detection signal when any load variation is equal to or larger than a predetermined value;

a timer means which is operable for a predetermined time in response to said detection signal;

a selector means controlled by said timer means and operable to select said digital pressure value during the period of time when said timer means is operative and said filter-processed pressure value during the period of time when said time means is inoperative; and a control means for controlling fuel injection of said engine on the basis of the number of revolutions of said engine and the pressure value or the filter-processed pressure value output from said selector means.

7. An apparatus as set forth in claim 6, wherein said predetermined period of time in which said timer means is operable extends between the time when said detection signal is input to said timer means and the time when said filter-processed pressure value becomes stable after the end of the variation in load.

8. An apparatus as set forth in claim 7, wherein said load variation detecting means is a means for monitoring a throttle opening to detect any variation in the opening.

9. An apparatus as set forth in claim 7, wherein said control means is a means for calculating volumetric efficiency on the basis of the number of revolutions of said engine and the pressure value or the filter-processed pressure value output from said selector means, thereby calculating a pulse width for controlling fuel injection on the basis of said calculated volumetric efficiency.

10. An engine control apparatus for controlling fuel injection of an engine on the basis of the number of revolutions of said engine, a throttle opening and a pressure value representing the pressure in the intake pipe of said engine, the apparatus comprising:

a digital filter means supplied with said pressure value and performing low-pass digital filter processing of said pressure value to output a filter-processed pressure value;

a load variation detecting means for monitoring variations in the throttle opening to output a detection signal when any variation in said throttle opening is equal to or larger than a predetermined value;

a timer means responsive to said detection signal to operate during the period between the time when said detection signal is input to said timer means and the time when said filter-processed pressure value becomes stable after the end of the variation in said throttle opening;

a selector means controlled by said timer means and operative to select said pressure value during the period when said timer means is operative and said filter-processed pressure value during the period when said timer means is inoperative;

a first means for calculating volumetric efficiency on the basis of the number of revolutions of said engine and the pressure value or the filter-processed pressure value selected by said selector means; and a second means for calculating the pulse width for controlling fuel injection of said engine on the basis of said calculated volumetric efficiency.

* * * * *